US006871475B2

(12) United States Patent
Romagnoli

(10) Patent No.: US 6,871,475 B2
(45) Date of Patent: Mar. 29, 2005

(54) APPARATUS FOR SEALING A FLATTENED TUBE OF HEAT-SEALABLE FILTER PAPER TO MAKE FILTER BAGS FOR INFUSION PRODUCTS

(75) Inventor: Andrea Romagnoli, San Lazzaro di Savena (IT)

(73) Assignee: Tecnomeccanica S.r.L., Bologna (IT)

( * ) Notice: Subject to any disclaimer, the term of this patent is extended or adjusted under 35 U.S.C. 154(b) by 0 days.

(21) Appl. No.: 10/623,915

(22) Filed: Jul. 21, 2003

(65) Prior Publication Data

US 2004/0016216 A1 Jan. 29, 2004

(30) Foreign Application Priority Data

Jul. 23, 2002 (IT) ..... BO2002A0478

(51) Int. Cl.[7] ..... B65B 7/00
(52) U.S. Cl. ..... 53/373.3; 53/373.7; 53/373.9
(58) Field of Search ..... 53/373.9, 373.3, 53/373.7

(56) References Cited

U.S. PATENT DOCUMENTS 3,775,222 A 11/1973 Aspin et al.
3,958,390 A 5/1976 Pringle, Jr. et al.
4,019,946 A * 4/1977 Greisman ..... 156/497
4,929,299 A 5/1990 Romagnoli
5,816,019 A * 10/1998 Saget et al. ..... 53/373.9
6,038,839 A * 3/2000 Linkiewicz ..... 53/551
6,053,230 A * 4/2000 Pelland ..... 156/359
6,471,803 B1 * 10/2002 Pelland et al. ..... 156/64

FOREIGN PATENT DOCUMENTS

IT 1207628 5/1989

OTHER PUBLICATIONS

European Search Report pertaining to European Application No. 03 42 5470.

* cited by examiner

*Primary Examiner*—Scott A. Smith
*Assistant Examiner*—Brian Nash
(74) *Attorney, Agent, or Firm*—Fay, Sharpe, Fagan, Minnich & McKee, LLP

(57) ABSTRACT

In a machine for making filter bags for infusion products, a flattened tube (34) is used which is made from a web (17) of filter paper that: is heat-sealable by thermal reactivation of a layer of glue; is fed continuously in the horizontal position; has individual charges (19) of the infusion product placed on its top surface at suitable intervals; and, lastly, is gradually folded onto itself until its longitudinal edges (18) are juxtaposed. An apparatus (250) for sealing the tube (34) comprises an operator block (94) bearing two rows (251) of emitters (96) designed to give off a gaseous fluid heated to a suitable temperature. The operator block (94), accommodated inside the tube (34) with the emitters (96) aligned and juxtaposed with the edges (18), directs the fluid against internal faces (97) of the tube (34) directly at the layer of glue on the web (17) which is simultaneously folded around the operator block (94) itself.

14 Claims, 3 Drawing Sheets

APPARATUS FOR SEALING A FLATTENED TUBE OF HEAT-SEALABLE FILTER PAPER TO MAKE FILTER BAGS FOR INFUSION PRODUCTS

BACKGROUND OF THE INVENTION

The present invention relates to the automatic production of filter bags for infusion products such as tea, chamomile and similar herbs, and relates in particular to a very advantageous sealing apparatus for use in machines for making the filter bags.

In the automatic packaging of products for infusion, prior art teaches the use of machines which continuously form filter bags by folding and sealing lengthwise a web of heat-sealable filter paper to make a flattened tube positioned horizontally and then sealing this tube crossways at defined intervals in such a way as to enclose individual charges of infusion product between two successive transverse heat seals. The flattened tube is then cut crossways into lengths, to which a thread and a pickup tag are applied in order to complete the filter bags.

As regards the sealing operations, which form the specific subject-matter of the present invention, prior patent IT 1207628 discloses a sealing apparatus comprising two blocks conformed so as to present pairs of stepped overlapping edges. The upper edge of each pair has a plurality of bores through which hot air from a heater is passed. The lower edges, on the other hand, have a lamellar structure. The two pairs of edges operate in mutual juxtaposition, on the outside of the tube of filter paper, combining to channel a stream of hot air against the edges of the tube, the edges of the tube being placed side by side in close contact with each other to form the generatrix of the tube and moving between the pairs of edges of the sealing apparatus. The hot air directed by the bores thermally and locally activates a layer of glue on the inside surface of the tube of heat-sealable filter paper. As the tube of filter paper moves along its feed path, it passes between two successive pairs of pressure rollers which make the longitudinal and transverse seals on the tube in such a way as to create the pouches containing the individual charges of infusion product.

In this type of sealing apparatus, the location of the heating blocks and the emission of hot air from the outside of the filter paper tube being formed result in considerable energy loss and low efficiency of the apparatus. Indeed, although the hot air can be emitted from the bores at quite a high speed, the horizontal distance that it has to travel before reaching the vertical edges of the filter paper to be sealed, and the fact that the blocks incorporating the bores are positioned outside the filter paper tube inevitably lead to a part of the stream of hot air being lost by natural convection without producing any useful effect on the working area.

Another factor that negatively influences energy efficiency is that the hot air strikes the face of the filter paper opposite the face with the glue to be reactivated on it, the reactivation thus being the result of the conduction of heat through the filter paper. Although the filter paper is very thin and by nature microporous, this mode of operation nevertheless further increases the overall inefficiency of the apparatus.

Further disadvantages of the apparatus described above lie in its complex and rather cumbersome structure.

The main aim of the present invention is to overcome the above mentioned disadvantages by providing an apparatus designed in such a way as to direct the stream of hot air entirely on the edges to be sealed, avoiding conditions that enable the hot air to bypass the sealing area, and in such a way that the stream of air is directed straight at the layer of glue to be reactivated.

Other aims of the invention are to provide an apparatus that: has a simple structure; is relatively inexpensive to make; and occupies much less space than prior art devices designed for the same purpose.

SUMMARY OF THE INVENTION

In accordance with the invention, these aims are achieved in an apparatus for sealing a flattened tube of heat-sealable filter paper to make filter bags for infusion products, where the tube is made from a web of filter paper that is sealable by thermal reactivation of a layer of glue, the web having individual charges of the infusion product placed on its top surface at suitable intervals and being fed continuously in the horizontal position and then folded onto itself until its longitudinal edges are juxtaposed, the apparatus comprising at least one operator block bearing at least one row of emitters designed to give off a gaseous fluid heated to a suitable temperature, the operator block being accommodated inside the tube being formed, the row of emitters being aligned and juxtaposed with the longitudinal edges of the web of filter paper, and the emitters giving off the gaseous fluid onto the faces of the inside edges of the tube directly on the glue on the web of filter paper as it is being folded over around the operator block.

BRIEF DESCRIPTION OF THE DRAWINGS

The technical characteristics of the invention, with reference to the above aims, are clearly described in the claims below and its advantages will be apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
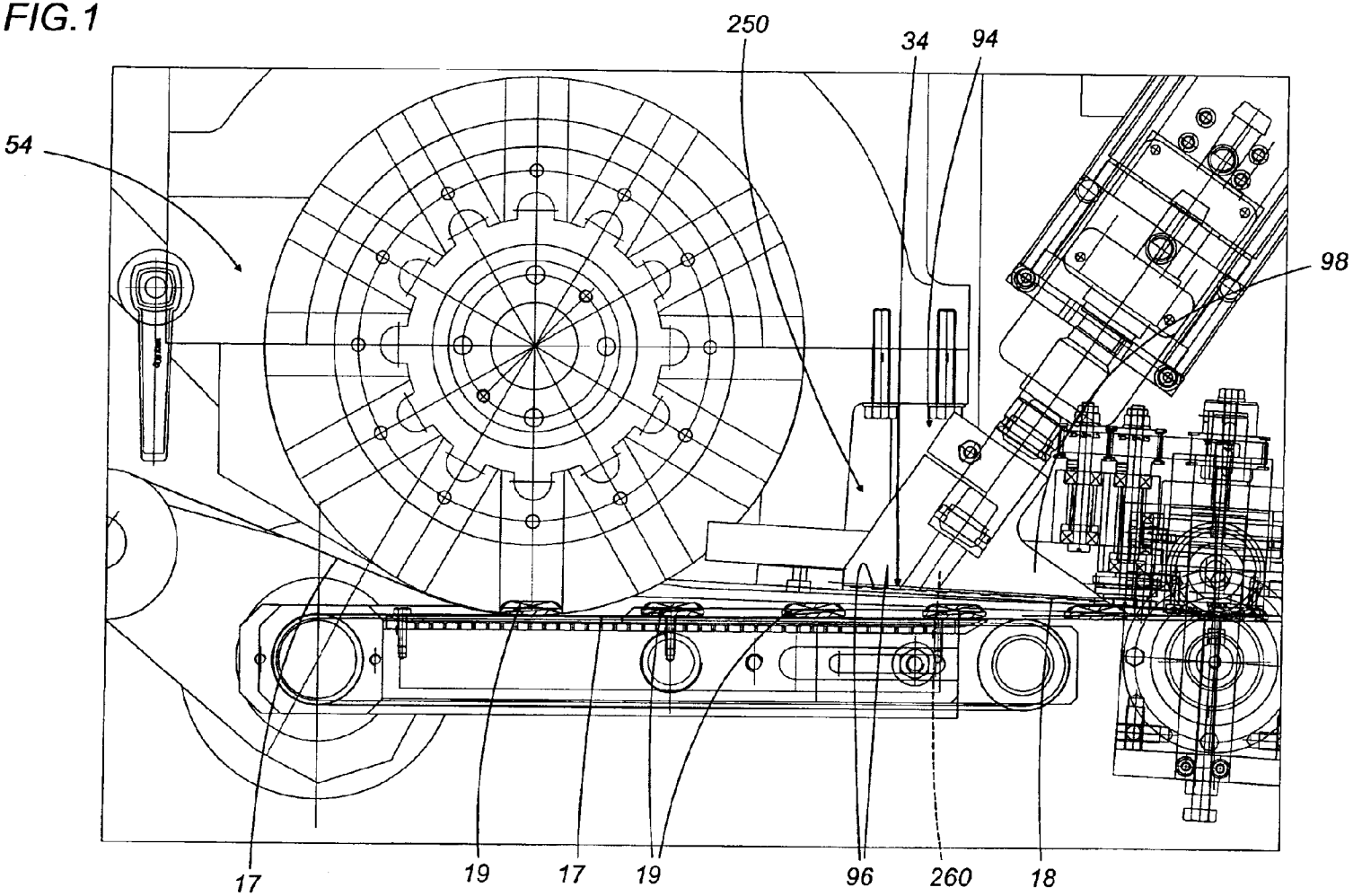
FIG. 1 is a perspective view of an infusion filter bag making machine equipped with an apparatus according to the present invention.

With reference to FIG. 1 of the accompanying drawings, the numeral 54 denotes in its entirety an automatic machine for making filter bags for infusion products such as tea, chamomile and similar herbs.

The automatic machine, which forms the subject matter of another patent application filed by the Applicant concurrently herewith, makes the filter bags in a number of steps, including the preparation of the flattened tube 34, the latter operation being performed by the apparatus according to the present invention, labeled 250 in its entirety.

More specifically, the tube 34 is made from a web 17 of filter paper bearing a layer of glue that can be thermally activated, the web being fed continuously in the horizontal position, and having individual charges 19 of the infusion product placed on its top surface at suitable intervals.

Figure 2:
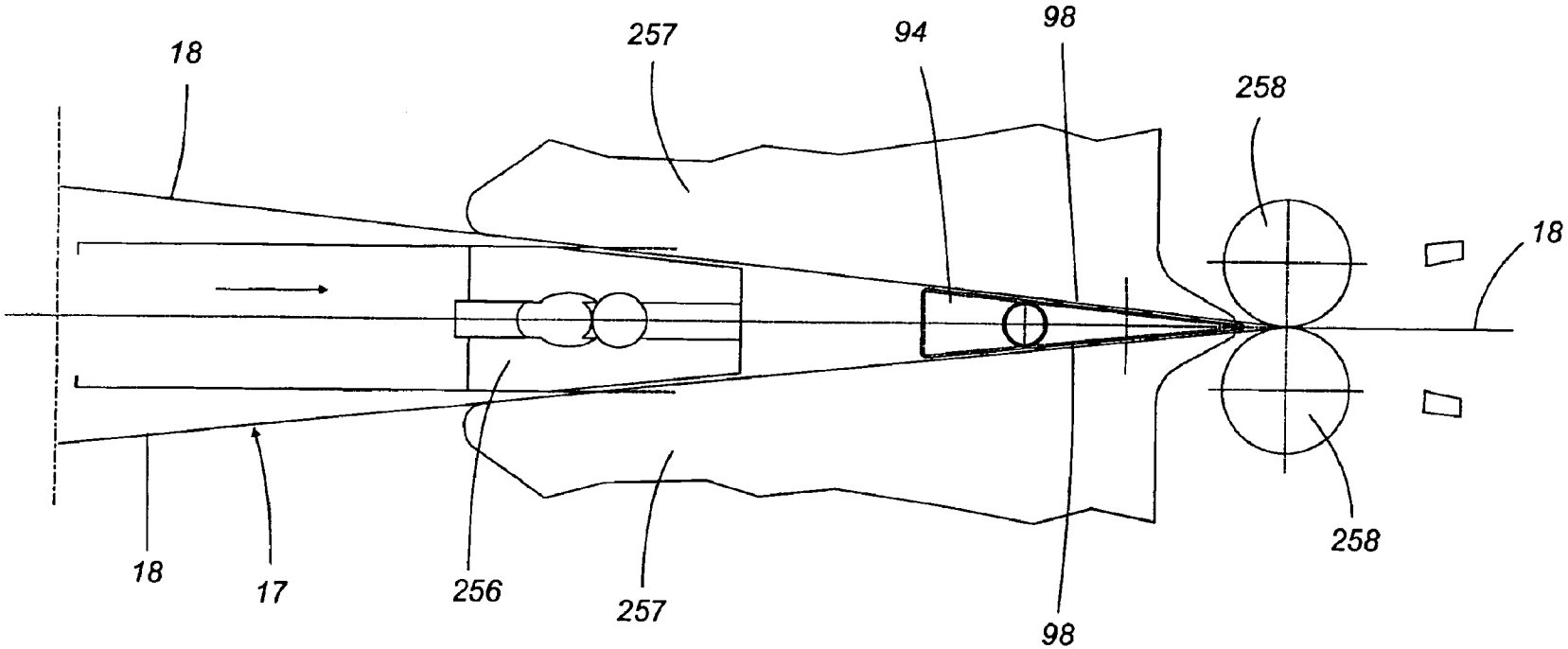
FIG. 2 schematically illustrates the apparatus of FIG. 1 in a plan view from above.

Suitable folding means, better illustrated in FIG. 2, and comprising a substantially wedge-shaped spindle 256 having on each side of it lateral counterfolders 257 shaped to match it, are used to gradually fold the web 17 onto itself until its longitudinal edges 18 are juxtaposed. Once the flattened tube 34 has been completely formed and the glue has been thermally reactivated, the longitudinal edges 18 are pressed against each other and sealed by suitable knurled rollers 258 which come into contact with each other, in such a way as to definitively close the tube 34.

The apparatus 250 comprises (FIG. 3) a single operator block 94 substantially in the shape of an elongated, tapering truncated pyramid with a substantially triangular base 261.

At its base 261, and adjacent to its oblique side walls 98, the operator block 94 has laterally projecting edges 252 that bear two corresponding rows 251 of emitters 96 designed to give off a gaseous fluid heated to a suitable temperature from a chamber 259 located inside the block 94 and communicating with the emitters 96 and, through a suitable conduit 260, to an external air heater, which is not illustrated in the drawings.

The operator block 94 is positioned in such a way as to be accommodated inside the tube 34 being formed and so that its wide end 253 faces the direction 254 opposite the direction in which the web 17 of filter paper is being fed. The two rows 251 of emitters 96 on the base of the oblique side walls 98 of the operator block 94, are aligned and juxtaposed with the longitudinal edges 18 of the web 17 of filter paper being formed into a tube.

The emitters, since they face the longitudinal edges 18 of the tube 34 and direct the heated gaseous fluid against internal faces 97 of the edges 18 of the tube 34, are thus able to act directly on the layer of glue on the web 17 of filter paper, reactivating the glue as the web 17 is gradually folded over above the operator block 94.

Figures 3, 4:
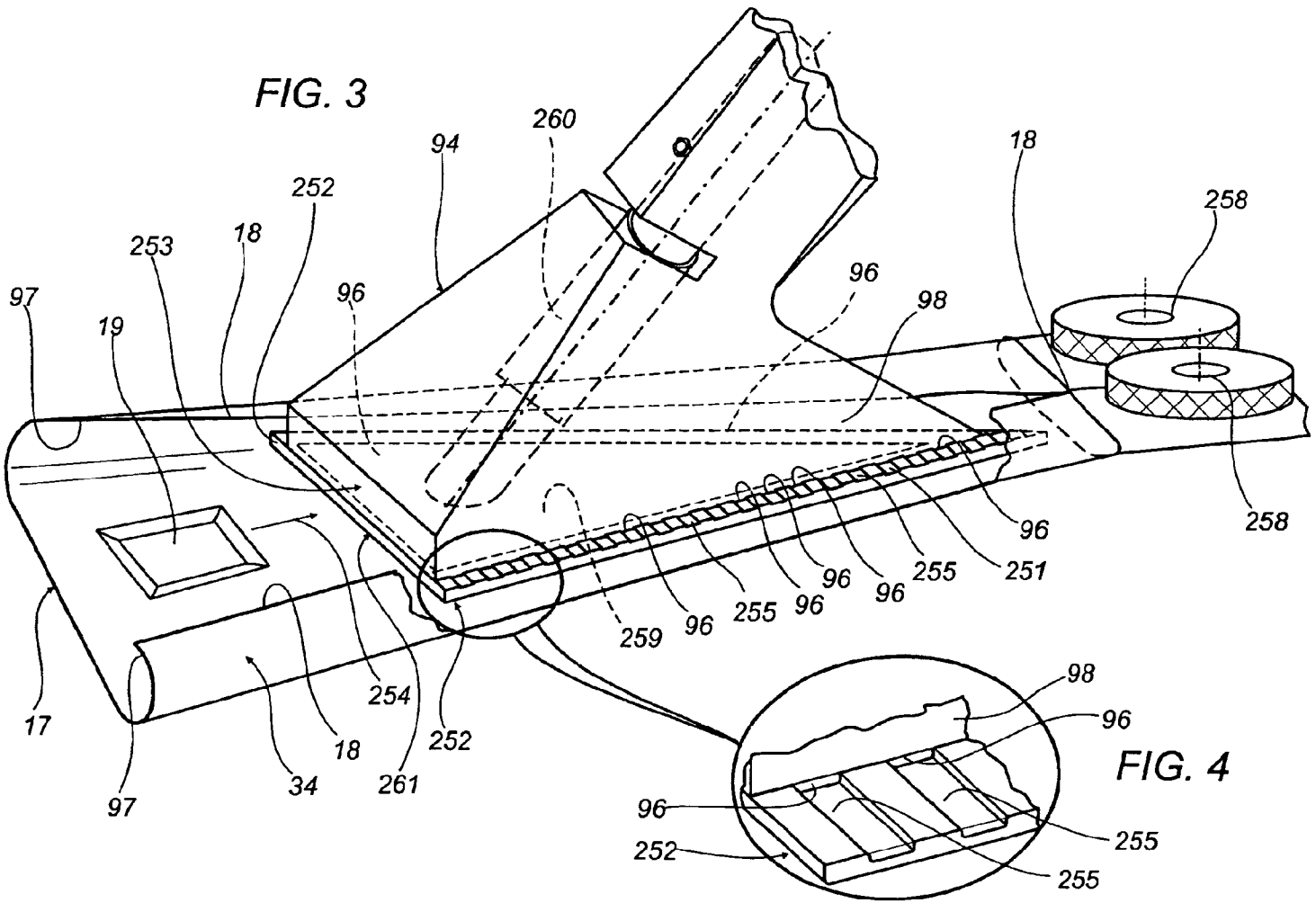
FIG. 3 is a highly enlarged perspective detail view showing a part of the apparatus of FIGS. 1 and 2.
FIG. 4 is a further enlarged detail view showing the part of the apparatus illustrated in FIG. 3.

As to the form of the emitters 96, FIGS. 3 and 4 show that the emitters are embodied preferably as apertures 96 passing through the oblique side walls 98 and all communicating with the chamber 259 located inside the operator block 94 and fed by the conduit 260.

The apertures 96 are substantially rectangular in shape and are alternated with channels 255 for diverting the fluid, facing the longitudinal edges 18 of the tube 34 above and formed in the laterally protruding edges 252 of the base 261 of the operator block 94.

The operation of the apparatus 250 is clearly discernible from FIG. 3. The web 17 of heat-sealable filter paper, lying in a horizontal position, is fed in the direction indicated by the arrow 254 by the pulling action exerted by the rollers 258, and gradually formed into a tubular shape around the operator block 94.

As a result, the web 17 forms a substantially conical open tube 34 in which the longitudinal edges 18 of the initial web 17 slide against the oblique side walls 98 of the operator block 94 and move closer and closer to each other until they are juxtaposed.

The sliding contact between the longitudinal edges 18 and the side walls 98 causes the edges 18 to move closely against the emitters 96, exposing the layer of glue on the inside faces 97 of the tube 34 to the hot air.

This exposure maximizes the effectiveness of the thermal reactivation of the glue.

Thus, reactivation is more efficient firstly because the hot air issuing from the emitters 96 strikes the facing layer of glue directly.

Secondly, glue reactivation is more efficient because the hot air issuing from the emitters 96 rises towards the open edges 18 of the tube 34 and, practically unable to escape from the area where the edges 18 of the web are in direct contact with the oblique side walls 98 of the operator block 94 can escape to the outside only through the back end of the tube 34 where the web 17 is still open. This means that the air is forced to follow a long path backwards, flowing past the edges 18 bearing the glue to be reactivated and transferring most of the heat carried by the air to the glue on the edges 18 along the way, thus further enhancing the effectiveness of thermal reactivation and at the same time reducing the amount of energy lost through transfer of unused heat to the outside atmosphere.

The apparatus 250 thus fully achieves the aforementioned aims of the invention through a relatively simple, economical structure that is at once effective and highly reliable.

It will be understood that the invention described may be useful in many industrial applications and may be modified and adapted in several ways without thereby departing from the scope of the inventive concept. Moreover, all the details of the invention may be substituted by technically equivalent elements.

What is claimed is:

1. An apparatus for sealing a flattened tube (34) of heat-sealable filter paper to make filter bags for infusion products, where the tube (34) is made from a web (17) of filter paper that is sealable by thermal reactivation of a layer of glue, the web (17) having individual charges (19) of the infusion product placed on its top surface at suitable intervals and being fed continuously in the horizontal position and then folded onto itself until its longitudinal edges (18) are juxtaposed, the apparatus (250) comprising at least one operator block (94) bearing at least one row (251) of emitters (96) designed to give off a gaseous fluid heated to a suitable temperature, the operator block being accommodated inside the tube (34) being formed, the row (251) of emitters (96) being aligned and juxtaposed with the longitudinal edges (18) of the web (17) of filter paper, and the emitters (96) giving off the gaseous fluid onto the faces of the inside edges (97) of the tube (34) directly on the glue on the web (17) of filter paper as it is being folded over around the operator block (94); the operator block (94) having the shape of an elongated, tapering solid and being positioned in such a way that its wide end (253) faces a direction (254) opposite the direction in which the web (17) of filter paper is being fed, the operator block (94) having oblique side walls (98) which are in contact with the longitudinal edges (18) of the tube (34) and which bear the emitters (96) in such a way that the emitters (96) face the inside of the tube (34) for reactivating the glue on the faces (97), wherein the sidewalls prevent gaseous fluid issuing from the emitters (96) from passing between the edges (18) and the oblique side walls (98).

2. The apparatus according to claim 1, comprising a single operator block (94).

3. The apparatus according to claim 2, wherein the operator block (94) comprises two rows (251) of emitters (96) juxtaposed with the longitudinal edges (18) of the tube (34) being formed.

4. The apparatus according to claim 2, wherein the single operator block (94) has laterally projecting edges (252) bearing the emitters (96) in such a way that the latter face the longitudinal edges (18) of the tube (34) of filter paper.

5. The apparatus according to claim 2, wherein the emitters are apertures (96) passing through the oblique side walls (98) and communicating with an internal chamber (259) common to both the rows (251) and supplied with the gaseous fluid.

6. The apparatus according to claim 2, wherein the apertures (96) are substantially rectangular in shape.

7. The apparatus according to claim 1, wherein the operator block (94) comprises two rows (251) of emitters (96) juxtaposed with the longitudinal edges (18) of the tube (34) being formed.

8. The apparatus according to claim 7, wherein the single operator block (94) has laterally projecting edges (252) bearing the emitters (96) in such a way that the latter face the longitudinal edges (18) of the tube (34) of filter paper.

9. The apparatus according to claim 7, wherein the emitters are apertures (96) passing through the oblique side walls (98) and communicating with an internal chamber (259) common to both the rows (251) and supplied with the gaseous fluid.

10. The apparatus according to claim 1, wherein the single operator block (94) has laterally projecting edges (252) bearing the emitters (96) in such a way that the latter face the longitudinal edges (18) of the tube (34) of filter paper.

11. The apparatus according to claim 1, wherein the emitters are apertures (96) passing through the oblique side walls (98) and communicating with an internal chamber (259) common to both the rows (251) and supplied with the gaseous fluid.

12. The apparatus according to claim 11, comprising channels (255) for diverting the fluid flow and communicating with the apertures (96).

13. The apparatus according to claim 1, wherein the apertures (96) are substantially rectangular in shape.

14. The apparatus according to claim 13, comprising channels (255) for diverting the fluid flow and communicating with the apertures (96).

* * * * *